United States Patent [19]

Markoo et al.

[11] 3,992,178

[45] Nov. 16, 1976

[54] FLEXIBLE COATED ABRASIVE WITH GRAPHITE OUTER LAYER

[75] Inventors: Erik L. Markoo; Hans S. Ekblom; Torsten Wilhelm Sandell, all of Markaryd, Sweden

[73] Assignee: Fabrika AB EKA, Sweden

[22] Filed: Apr. 9, 1974

[21] Appl. No.: 459,410

[30] Foreign Application Priority Data

Apr. 17, 1973 Sweden ..... 7305416

[52] U.S. Cl. ..... 51/295; 51/298 A; 51/301

[51] Int. Cl.[2] ..... B24D 11/00

[58] Field of Search ..... 51/295, 298, 306, 307, 51/293, 301

[56] References Cited

UNITED STATES PATENTS

| | | | |
|---|---|---|---|
| 2,050,992 | 8/1936 | Aust | 51/295 |
| 2,233,175 | 2/1941 | Melton | 51/298.1 |
| 3,163,968 | 1/1965 | Nafus | 51/295 |
| 3,168,387 | 2/1965 | Adams | 51/295 |
| 3,282,665 | 11/1966 | Myers | 51/295 |
| 3,377,264 | 4/1968 | Duke et al. | 51/295 |

FOREIGN PATENTS OR APPLICATIONS

| | | | |
|---|---|---|---|
| 1,256,520 | 12/1971 | United Kingdom | 51/295 |

*Primary Examiner*—Donald J. Arnold

[57] ABSTRACT

A flexible abrasive article carries a layer of particles of electroconductive material on the outer surface of the abrasive side to reduce the buildup of electrostatic charge during use in sanding wood or grinding metal. Metallic and non-metallic electroconductive materials may be employed.

4 Claims, No Drawings

FLEXIBLE COATED ABRASIVE WITH GRAPHITE OUTER LAYER

FIELD OF THE INVENTION

The present invention relates to flexible coated abrasive articles, particularly endless abrasive belts, having antistatic properties, and a method for the manufacture of such abrasive articles.

BACKGROUND OF THE INVENTION

Flexible coated abrasive articles generally comprise a flexible backing material, usually made of woven or nonwoven fibers or paper or a combination of these materials, one side of which is provided with adhesively anchored abrasive grits. When these articles are used in an endless belt machine to sand wood and plastic, and often when they are used to grind some metals, such as light metal alloys, voltages in the order of magnitude from 50 to 100 kilovolts may be generated. The voltage is generated where the endless belt travels between a back support and the workpiece. The high electrostatic voltage is of considerable inconvenience. A sudden discharge may take place and cause a serious accident by shocking the workman to a sudden, uncontrolled movement. The charge also causes the working space to become dusty and dirty due to electrostatic accumulation of dust on machines and workpieces, which, due to their electrical charge, are not removed by the usual suction means. If the dust is very fine, it may also be held in suspension in the air for a very long time, contaminating the entire working area and presenting an obvious health hazard as well.

Many common kinds of wood retain a residual charge for a very long time. It has proved nearly impossible in practice to use any dry process to remove this dust prior to painting, or the like. It is, of course, not very convenient to use wet process since the wood fibers then tend to "rise" and roughen the surface. It should be obvious from the above that a method for removing or preventing electrostatic charges in work of the above mentioned kind would be of great advantage.

One method of accomplishing this has been described in the copending application of Eric L. Markoo, Tore G. H. Strand and Thorsten W. Sandell, entitled "Abrasive Articles," Ser. No. 387,748, filed Aug. 13, 1973, and now U.S. Pat. No. 3,942,959 which proposes an electroconductive layer in the abrasive article, sandwiched between two non- or semi-conducting layers. Such an abrasive article has proved to be extremely effective, and even after prolonged use no electrostatic charge buildup has been measurable. It would thus appear that providing a continuous layer of electroconductive material in a conventional abrasive article would present a complete solution to the problem related above. However, flexible coated abrasive articles of this kind are manufactured in fully automatic plants, and not all articles need to be anti-electrostatic. There is a need, therefore, for a method of providing conventional abrasive articles with anti-electrostatic properties without having to change the standard manufacturing process.

It should be pointed out that although metallizing the abrasive article would seem to be an obvious expedient, it is, unfortunately, no useful way of solving the electrostatic problem. Probably due to heat reflection, a metallized abrasive belt may become extremely hot during dry-sanding of wood. In addition, it is not a good practice to metallize the abrasive side, since this may contaminate the workpiece with metal particles, which later may discolor the wood and/or react with lacquer or varnish or dye.

SUMMARY OF THE INVENTION

It is thus an object of the invention to provide an abrasive article that has anti-static properties and can be manufactured using conventional production equipment.

It is also an object of the invention to provide such an abrasive article, such as disks and sheets, but particularly those in the form of an endless belt.

These and other objects of the invention are fulfilled by the present invention, which provides an abrasive article having a flexible backing member, abrasive grits embedded and held in at least one layer of adhesive on one side of the flexible backing member, and particles of an electroconductive material on said adhesive layer in an amount effective to at least reduce buildup of electrostatic charge during sanding or grinding, said electroconductive material being selected from the group consisting of metals, non-metals and synthetic resins.

The abrasive article of the invention may be prepared by coating the outer surface of the abrasive side of a conventional abrasive article with the particles of the electroconductive material so as to form a layer of particles of electroconductive material over the abrasive grits. The resulting anti-electrostatic layer provides a strong, electroconductive cover over the abrasive article. After use, when the points of the abrasive material have been laid bare, a network of electroconductive material remains between the grits. This network is as effective for the elimination of electrostatic charges as is a continuous layer.

The abrasive articles to be treated according to the invention are conventional abrasive articles having abrasive grits embedded in adhesive carried by a flexible backing. The flexible backing may be woven or non-woven textile material, such as cotton, or paper, the adhesive layer may be synthetic or animal glue and the abrasive grits are any of those conventionally employed.

The electroconductive material may be any electroconductive particulate material, metallic or non-metallic, such as graphite, zinc, copper, iron, aluminum, silver, tin, lead, nickel, ionizable salts and complexes thereof, ionizable salts and complexes of sodium, potassium and cadmium, or the like; as well as electroconductive polymers, such as polymeric vinylbenzene trimethyl ammonium chloride; 14fg, oligo-2 (Tomoegawa Paper Company), etc. The particle size is conveniently in the range of from .1 to 100 microns. In general, the smaller particle sizes, such as from 1 to 10 microns are more desirable, since less electroconductive material per unit area can be used.

The electroconductive material need not be "conductive" in the usual sense of the word, i.e. it does not have to be a metallic conductor. Simple trial and error experiments with a given material will readily establish whether or not it is sufficiently electroconductive. Thus, an abrasive article can be coated at various weights per square meter and tested as described below for static charge to determine if it is effective to reduce the static charge.

The electrical conductivity of the electroconductive material can vary quite widely over a large range of electrical conductivity, and still give good reduction of the electrostatic charge when used in accordance with the present invention, probably due to the comparatively large voltage and low current encountered. For example, excellent results have been obtained when the layer of electroconductive material has a resistance, as measured between point contacts 1 cm. apart, of $10^{-3}$ megohm to 5 megohm. Since the term "electroconductive" is relative, in that a material is a conductor or an insulator only with relationship to the environment involved, the precise level of electroconductivity for the electroconductive material must be empirically determined, bearing in mind that the outer surface of a conventional abrasive article, namely the adhesive layer in which the abrasive grits are embedded, is to be considered as an "insulator", and thus the layer of electroconductive material is "conductive" relative to this insulating layer. In general, electroconductive materials having an electrical resistance of less than 20 megohms will be suitable for use in the present invention, and the simple test outlined above can readily be employed to determine the suitability of a given material and the optimum thickness and/or weight of the electroconductive layer.

The electroconductive material is coated over the abrasive surface of the abrasive article in a thin layer so as to just cover the abrasive grains. For example, a layer containing 1 to 100 grams of electroconductive material per square meter of abrasive article, particularly 5 to 75 grams per square meter, may suitably be used. As the layer wears away, there will remain a network of electroconductive material surrounding the abrasive grits. It is convenient to apply the electroconductive material in an admixture with a binder, such as a glue, the admixture being dispersed in water. The binder may also be a resin dissolved or dispersed in a volatile solvent or carrier. The dispersion is coated over the abrasive surface of the abrasive article, such as by spraying or by spreading with a roller, and the coated article dried at elevated temperature, such as 40°–200° C, until the coating is dried and cured, such as from a few seconds to 3 hours.

Alternatively, graphite may be coated over the abrasive article without any glue or other binder, and heated to 100°–130° C for 1 to 3 minutes to secure the graphite to the abrasive article.

EMBODIMENTS OF THE INVENTION

The following Examples illustrate the invention. All parts and percentages are by weight, unless expressly stated otherwise.

Example 1

A conventional flexible abrasive material, manufactured and sold by Fabriks AB Eka of Sweden under the trade name EKAMANT was treated in the following manner:

A composition was prepared which consisted of 100 parts of a carbamide glue, 5 parts of ammonium chloride as curing agent, and 200 parts of coarse dispersed graphite having an average particle size of from 5 to 7 microns. To this mixture was added 200 parts of water and the composition obtained was spread uniformly over the abrasive surface of the abrasive cloth in an amount of approximately 45 g/m². After drying and curing for approximately 1.5 hours at 45° C, the coated article was tested in a belt grinding machine at normal working conditions, and the electrostatic charge, when measurable, was of the order of 0.1% of the charge measured at the same conditions using the same EKAMANT abrasive material, but untreated.

Using an electrostatic voltmeter, the probe of which was placed near the surface of the belt where it had just left the workpiece and back support member, may often give a reading of from 50 to 100 kilovolts when the abrasive belt has not been treated. Repeating the same measurement for a coated abrasive belt at the end of the useful life of the belt shows only a charge of 1 volt or less, a voltage which is difficult to detect in practice.

The improvement with respect to dust disperged in the air as well as dust accumulation on machines and working pieces is very large, in fact so large that the disadvantages inherent in conventional grinding belts are completely eliminated.

Example 2

Following the procedure of Example 1, but using a colloidal graphite dispersion of which 90% of the particles are less than 1 micron in place of the coarse graphite, a mixture of glue, curing agent and graphite was formed. 120 parts of this mixture were added to 50 parts of water and the resulting composition was spread in an amount of 35 g/m² over the surface of the abrasive material. The material was dried and cured as in Example 1, and the anti-electrostatic properties were equal to or better than the material according to Example 1. Although the treatment with colloidal graphite is somewhat more expensive, it is in many cases preferable to the less expensive use of coarser graphite since the possible risk for contamination of the workpiece is entirely eliminated, although no such contamination has been found even with the coarser graphite.

Example 3

Following the procedure of Example 1, an aqueous colloidal dispersion of graphite (90% < 1 micron) was spread over several abrasive articles and dried at 150° C for 30 to 300 seconds to provide a series of coated articles having a coating of 6 grams of graphite (dry basis) per square meter of abrasive article. Each of these articles showed an effective reduction of electrostatic charge.

Example 4

A coating composition, prepared from 200 parts of polymeric vinylbenzyl trimethyl ammonium chloride (sold by Dow Chemical Company under the trademark ECR 34) and 100 parts of water was spread over a conventional No. 100 abrasive material using a roller and a coating speed of 20 meters/minute. The coated article was dried in a tunnel at 40° C.

Using the procedure of Example 1, the maximum electrostatic charge was measured at 4.0 volts and there was substantially reduced dust in the air and on the belt machine.

We claim:

1. In a flexible abrasive article, comprising a flexible backing, an adhesive layer on said backing, and abrasive grits embedded in said adhesive layer, the improvement comprising an outer layer coated over said adhesive layer and said grits, said outer layer comprising an adhesive containing graphite particles having a size from 0.1 to 100 microns, the amount of graphite being from 1 to 100 grams per square meter of said abrasive article and sufficient to provide said outer layer with an electrical resistance of less than 5 megohm as measured between points 1 cm. apart.

2. The article according to claim 1, wherein said graphite is of a particle size of 1 to 10 microns.

3. The article according to claim 1, wherein said graphite is of 5 to 7 micron particle size.

4. The article according to claim 1, wherein said graphite is of 90% less than 1 micron particle size.

* * * * *